US012357050B1

(12) United States Patent
Canton et al.

(10) Patent No.: US 12,357,050 B1
(45) Date of Patent: Jul. 15, 2025

(54) HEAD COVERING

(71) Applicant: Eidos Technology, LLC, Pittsburgh, PA (US)

(72) Inventors: Stephen P. Canton, Pittsburgh, PA (US); Michael H. Canton, Pittsburgh, PA (US)

(73) Assignee: Eidos Technology, LLC, Pittsburgh, PA (US)

( * ) Notice: Subject to any disclaimer, the term of this patent is extended or adjusted under 35 U.S.C. 154(b) by 0 days.

(21) Appl. No.: 18/290,944

(22) PCT Filed: Jul. 21, 2022

(86) PCT No.: PCT/US2022/037861
§ 371 (c)(1),
(2) Date: Jan. 22, 2024

(87) PCT Pub. No.: WO2023/004034
PCT Pub. Date: Jan. 26, 2023

Related U.S. Application Data

(60) Provisional application No. 63/224,011, filed on Jul. 21, 2021.

(51) Int. Cl.
*A42B 1/041* (2021.01)
*A42B 1/22* (2006.01)

(52) U.S. Cl.
CPC ..... *A42B 1/041* (2013.01); *A42B 1/22* (2013.01)

(58) Field of Classification Search
CPC ..... A42B 1/041; A42B 1/22; A42B 1/012; A42B 1/002; A42B 1/04; A42B 1/049;
(Continued)

(56) References Cited

U.S. PATENT DOCUMENTS 1,638,756 A * 8/1927 Wallman ..... A45D 8/36 132/273
1,787,727 A * 1/1931 Hildreth ..... A42B 1/002 206/9

(Continued)

FOREIGN PATENT DOCUMENTS

CN 108552659 A * 9/2018 ..... A42B 1/04

OTHER PUBLICATIONS

International Search Report and Written Opinion dated Oct. 26, 2022 issued in corresponding International Application No. PCT/US2022/037861.

*Primary Examiner* — Amy Vanatta
(74) *Attorney, Agent, or Firm* — Eckert Seamans Cherin & Mellott LLC

(57) ABSTRACT

A head covering configured to contain and conceal a full volume of a wearer's hair. The head covering includes a cap having a top region or panel and a circumferential side region or panel extending from the top region, wherein an edge of the side region may be cinched over a full volume of a wearer's hair. The head covering further includes a frame positionable within an inner circumference of the side region, wherein the frame allows adjustment of a circumferential diameter of the frame to fit the wearer's head. For user's having long hair, the head covering may also include a pouch portion releasably connectable to a rear side of the cap. The pouch portion may include a cinchable border configured to collapse a circumferential opening thereof to contain and conceal a length of the wearer's hair extending from a nape of the wearer's neck.

20 Claims, 9 Drawing Sheets

(58) Field of Classification Search
CPC ..... A42B 1/205; A42B 1/12; A42B 1/201; A42B 1/225; A45D 8/40
USPC ..... 2/195.5, 182.6, 183, 181, 181.2, 181.6, 2/182.1, 182.3
See application file for complete search history.

(56) References Cited

U.S. PATENT DOCUMENTS 2,111,746 A * 3/1938 Bowers ..... A42B 3/145 2/8.1
D133,490 S * 8/1942 Burns ..... D2/883
2,609,823 A * 9/1952 Neff ..... A45D 8/40 132/273
3,555,565 A * 1/1971 Zimmon et al. ..... A42B 1/012 2/195.7
4,011,598 A 3/1977 Sherr et al.
4,378,606 A * 4/1983 Snowden ..... A42B 1/041 2/200.1
4,999,846 A * 3/1991 Ball ..... A42B 1/22 2/418
5,437,064 A * 8/1995 Hamaguchi ..... A42B 1/08 2/909
5,652,959 A 8/1997 Proctor
6,341,382 B1 * 1/2002 Ryvin ..... A42B 3/145 2/418
D624,284 S * 9/2010 Creel ..... D2/867
8,650,665 B2 * 2/2014 Shirai ..... A41F 1/008 2/183
9,179,729 B2 * 11/2015 Cotterman ..... A42B 3/08
10,661,122 B1 5/2020 Banks
2005/0144702 A1 * 7/2005 Whitney ..... A42B 1/041 2/202
2010/0064418 A1 3/2010 Graham
2010/0113991 A1 5/2010 Wu
2010/0281661 A1 * 11/2010 Harada ..... A44B 11/06 24/593.11
2014/0101821 A1 4/2014 Dagman et al.
2014/0101827 A1 4/2014 Dennis
2016/0198830 A1 * 7/2016 Tussey ..... A42B 1/049 2/183
2019/0045864 A1 2/2019 Teat et al.
2020/0390178 A1 * 12/2020 Karr Johnson ..... A42B 1/0182
2022/0095732 A1 * 3/2022 Newman ..... A44B 11/065
2024/0074528 A1 * 3/2024 Greenwood ..... A45D 8/40

* cited by examiner

HEAD COVERING

CROSS-REFERENCE TO RELATED APPLICATIONS

This application is a U.S. national stage filing under 35 U.S.C. § 371 of International Application No. PCT/US2022/037861 filed on Jul. 21, 2022, which claims priority under 35 U.S.C. § 119 (e) to U.S. Provisional Application No. 63/224,011 filed on Jul. 21, 2021, the entire contents of which are hereby incorporated by reference.

TECHNICAL FIELD

The disclosure relates generally to head coverings, and more specifically, to head coverings configured to cover long or voluminous hair.

BACKGROUND

Health care professionals typically wear a surgeon's cap during medical procedures to prevent contact with hazardous materials such as blood or other bodily fluids, and/or to cover their hair to protect the sterile environment. Traditional surgeon's caps only come in a few sizes and do not provide a secure enough fit for many health care professionals. Surgeon's caps also do not adequately cover the extra volume of hair of a person with long hair or a person of color, requiring health care professionals to also don one or more bouffant caps and/or hair nets to try to cover these regions. Even typical bouffant caps are not designed for the extra volume of hair, especially for people of color, and may thus not adequately cover the wearer's hair. Moreover, bouffant caps and hair nets are prone to leave red marks and indentations on the forehead after use due to the use of an elastic band to secure the caps around the head, and generally cannot support headlamps or other equipment that may be used by a health care professional.

Consequently, there is a need for a head cover that overcomes the aforementioned shortcomings of existing surgeon's caps and bouffant caps.

SUMMARY

The presently disclosed invention solves many of the aforementioned problems by providing a head covering configured to contain and conceal a full volume of a wearer's hair. The head covering generally comprises a cap portion configured to fit over a wearer's head, and a pouch portion releasably or non-releasably attached at the back side of the side panel. The pouch portion may comprise a cinchable border configured to collapse a circumferential opening of the pouch portion to contain and conceal a length of the wearer's hair extending from a nape of the wearer's neck.

The head covering may comprise a lining connected to at least the front side of the cap portion on an inner circumference thereof, wherein the lining is configured to prevent traction at a hairline of the wearer.

The head covering may comprise a frame positionable within an inner circumference of the side panel, the frame configured to be removeable and to adjust a circumferential diameter thereof to fit a wearer's head.

All references, including any patents or patent applications cited in this specification are hereby incorporated by reference. No admission is made that any reference constitutes prior art. The discussion of the references states what their authors assert, and the applicants reserve the right to challenge the accuracy and pertinence of the cited documents. It will be clearly understood that, although a number of prior art publications are referred to herein, this reference does not constitute an admission that any of these documents form part of the common general knowledge in the art.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e., that it will be taken to mean an inclusion of not only the listed components it directly references, but also other non-specified components or elements. This rationale will also be used when the term 'comprised' or 'comprising' is used in relation to one or more steps in a method or process.

BRIEF DESCRIPTION OF THE DRAWINGS

Aspects, features, benefits and advantages of the embodiments herein will be apparent with regard to the following description, appended claims, and accompanying drawings. In the following figures, like numerals represent like features in the various views. It is to be noted that features and components in these drawings, illustrating the views of embodiments of the present invention, unless stated to be otherwise, are not necessarily drawn to scale.

DETAILED DESCRIPTION

Figure 1A:
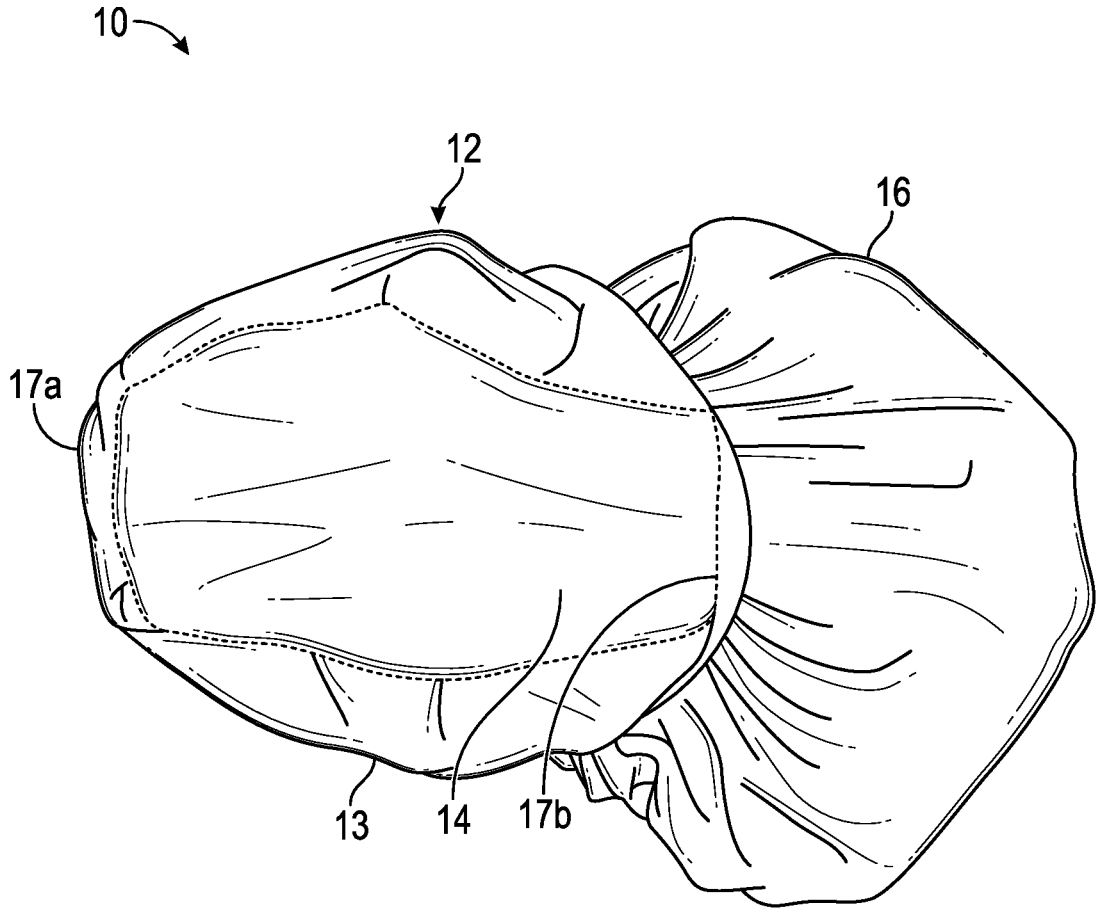
FIG. 1A illustrates a top view of a head covering with an attached pouch portion according to various aspects of the present disclosure.

In the following description, the present invention is set forth in the context of various alternative embodiments and implementations involving head coverings, and in particular, head coverings configured for long or voluminous hair and/or capable of covering a variety of hair styles. The head coverings disclosed herein may find use for any function that requires a wearer's hair to be fully covered, such as in the food industry, sterile manufacturing, and/or medical environment. In particular, the head coverings may find use as surgical caps for wearers with voluminous hair, covering long hair and a wide range of hair styles.

Various aspects of the head coverings disclosed herein may be illustrated by describing components that are coupled, attached, and/or joined together. As used herein, the terms "coupled", "attached", and/or "joined" are interchangeably used to indicate either a direct connection between two components or, where appropriate, an indirect connection to one another through intervening or intermediate components. In contrast, when a component is referred to as being "directly coupled", "directly attached", and/or "directly joined" to another component, there are no intervening elements shown in said examples.

Various aspects of the head coverings disclosed herein may be illustrated with reference to one or more exemplary implementations. As used herein, the term "exemplary" means "serving as an example, instance, or illustration," and should not necessarily be construed as preferred or advantageous over other variations of the systems or methods disclosed herein. "Optional" or "optionally" means that the subsequently described event or circumstance may or may not occur, and that the description includes instances where the event occurs and instances where it does not.

Those skilled in the art will recognize that the various embodiments disclosed herein can be practiced without one or more of the specific details or with other methods, components, materials, etc. In other instances, well-known structures, materials, or operations are not shown or not described in detail to avoid obscuring aspects of the embodiments.

Certain terminology is used in the following description for convenience only and is not limiting. The words "lower," "upper," "bottom," "top," "front," "back," "left," "right," and "sides" designate directions in the drawings to which reference is made but are not limiting with respect to the orientation in which the head coverings or parts thereof are shown.

It must also be noted that as used herein and in the appended claims, the singular forms "a", "an", and "the" include the plural reference unless the context clearly dictates otherwise. Thus, for example, reference to "a" frame, "an" attachment element, or "the" material, is a reference to one or more of each and equivalents thereof known to those skilled in the art, and so forth. Unless defined otherwise, all technical and scientific terms used herein have the same meanings as commonly understood by one of ordinary skill in the art.

"Substantially", as used herein, is understood to mean that a value or measurement is within 10% of a listed value, such as within 5%, or even 3% of a listed value.

Turning to the figures, a head covering according to the present disclosure, and various portions thereof, is shown in FIGS. 1-6B.

With reference to FIG. 1A, the head covering 10 generally comprises a cap portion 12 having a top panel 14 and a circumferential side panel 13 that extends from the top panel 14. The side panel 13 generally has a front side 17*a* and a back side 17*b* configured to be coincident with the front and back, respectively, of a wearer's head. The head covering 10 may further include a pouch portion 16 attachable to the back side 17*b* of the side panel 13.

While shown in the figures to include separate portions, i.e., a top panel 14 and a side panel 13 connected via a seam, other configurations of the cap portion 12 are possible and within the scope of the present invention. For example, the cap portion 12 may be formed of a single piece of material, or may be formed of several portions of material connected along a bisecting seam or intersecting seams, etc. As such, use of the term region, e.g., top region and/or side region, in the claims may be understood to refer an area of the cap portion as configured according to any of these variations (e.g., one-piece, top panel and side panel, multiple panels, etc.).

The cap portion 12 and the pouch portion 16 may be composed of a textile, such as a washable natural or synthetic fabric. Exemplary washable fabrics include at least cotton, polyester, rayon, wool, olefin, nylon, spandex, modacrylic, acrylic, linen, and blends thereof.

Figure 1B:
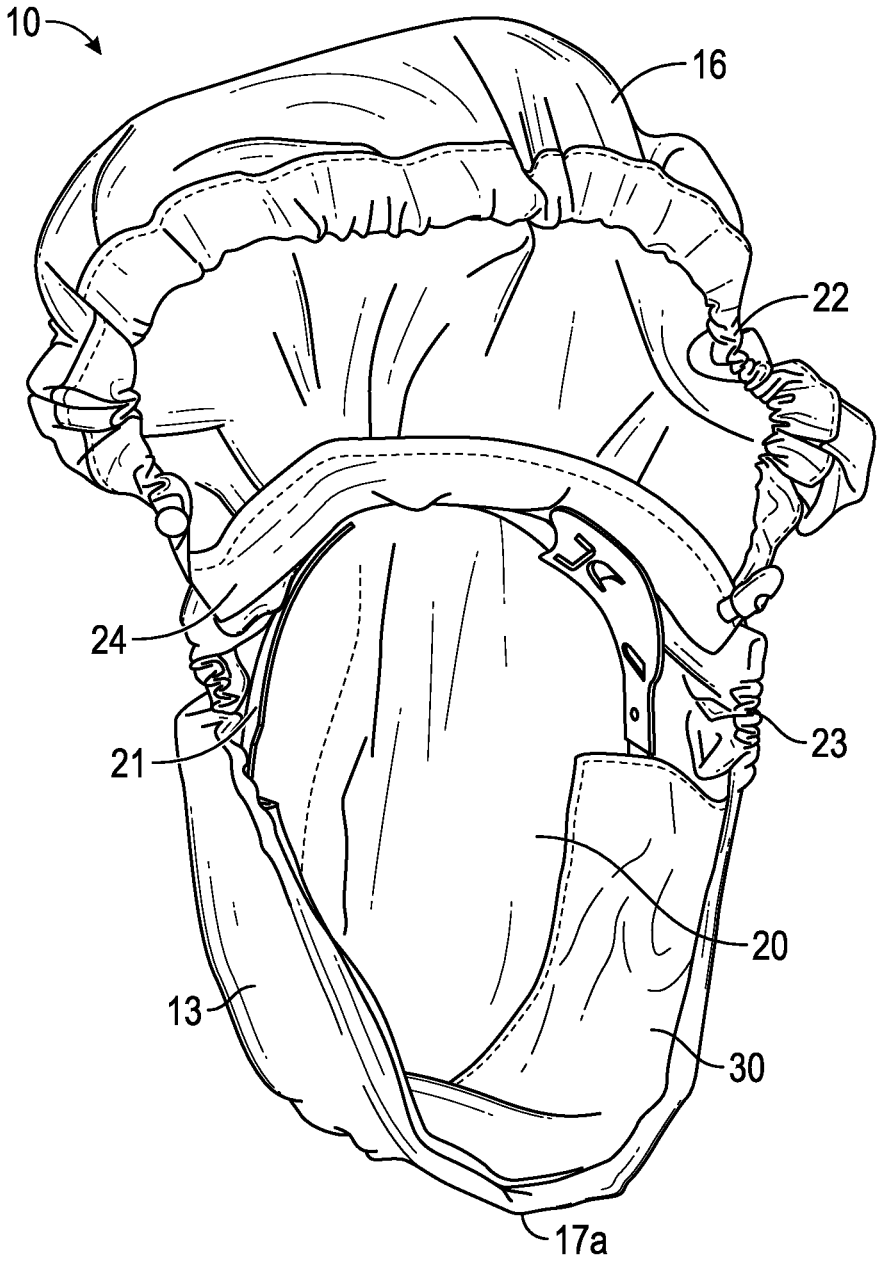
FIG. 1B illustrates a bottom inside view of the head covering shown in FIG. 1A.
Figure 4A:
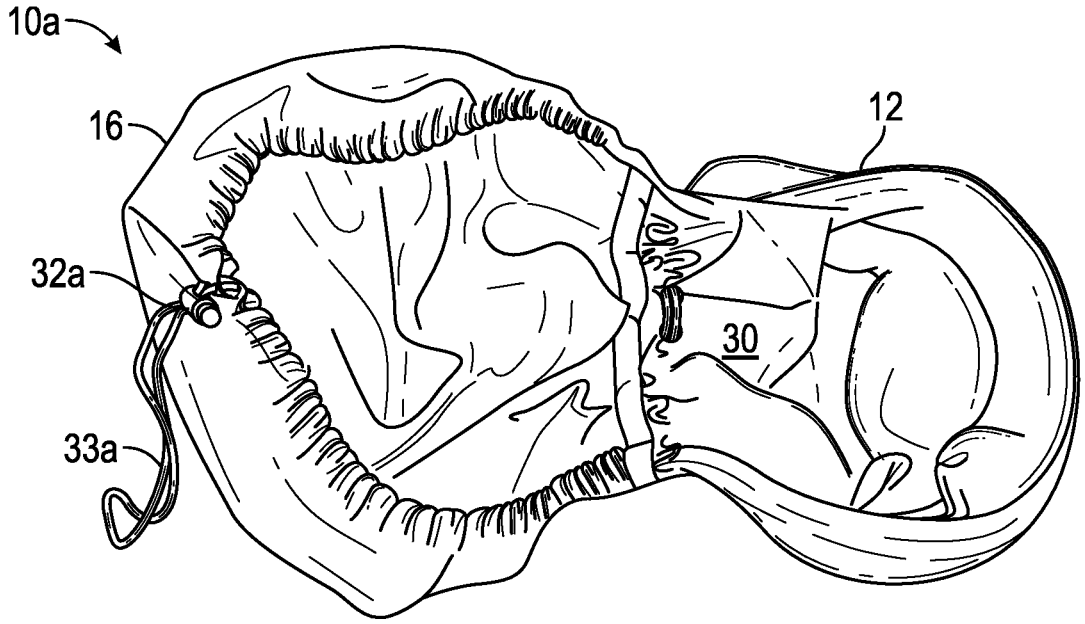
FIG. 4A illustrates a bottom inside view of the head covering of FIG. 3 shown without a frame according to various aspects of the present disclosure.
Figure 4B:
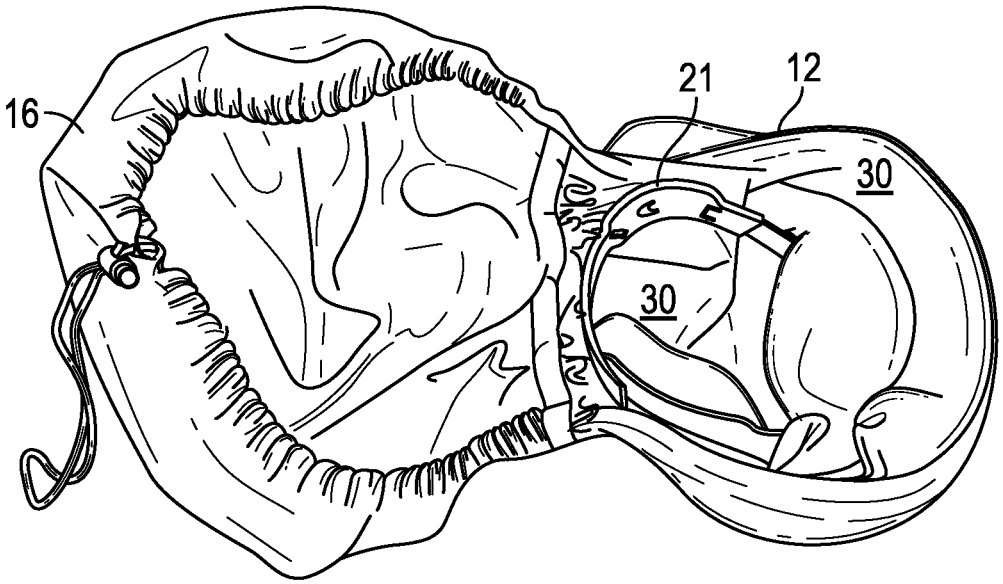
FIG. 4B illustrates a bottom inside view of the head covering of FIG. 3 showing internal components and a frame according to various aspects of the present disclosure.

With reference to FIG. 1B, an interior head receiving cavity 20 of the head covering 10 is shown. An inside of the cap portion 12 is shown to include a lining 30. The lining 30 may be attached/attachable to an inner circumference of the side panel 13, such as along all of or at least a portion of the inner circumference of the side panel 13 centered on the front side of the side panel (e.g., adjacent the forehead area of the wearer). That is, the lining 30 may extend around at least 20% of the inner circumference of the side panel 13, centered on the front side of the side panel, such as at least 30%, or 40%, or 50%, or 60%, or 70%, or 80%, or 90%, or even 100% of the inner circumference of the side panel 13 (i.e., the full circumference of the side panel). As shown in FIG. 1B, the lining 30 extends around about 50% of the inner circumference of the side panel 13. As shown in FIGS. 4A and 4B, the lining 30 extends around about 100% of the inner circumference of the side panel 13.

The lining 30 may extend along all of or at least a portion of the inner side of the side panel from a distal edge of the side panel. For example, the lining 30 may extend from an edge of the side panel distal from the top panel 14 up to a connection point with the top panel of the cap, such as shown in FIG. 1B (e.g., adjacent a bottom edge of side panel at the forehead area of the wearer up to and including the hairline or above). The lining 30 may extend from an edge of the side panel 13 distal from the top panel 14 past the connection point with the top panel of the cap portion 12, such as shown in FIG. 4A (e.g., adjacent a bottom edge of side panel at the forehead area of the wearer up to a point near a center of the top panel 14).

According to certain aspects, a bottom longitudinal edge of the lining 30 may be non-releasably attached to the distal edge of the side panel and a top longitudinal edge opposite from the bottom longitudinal edge may remain un-attached. The top longitudinal edge of the lining 30 may be releasably attachable to the side panel 13, or a region on the top panel 14, such as by buttons, snaps, hook and loop closures (Velcro™), and the like.

The lining 30 is included to prevent traction at a hairline of the wearer, which can lead to traction alopecia. Accordingly, the lining may be a slippery or slick material. Exemplary materials include any of silk, satin, rayon, rayon related material (e.g. viscose, TENCEL™ Lyocell, modal), peachskin, cupro, and any combination or blend thereof. The lining 30 may further absorb sweat in the head region of the wearer, such as along at least the forehead region of the wearer. As such, the lining may include an absorbent fabric or material. For example, the lining may include an outer slick material that prevents traction at a hairline of the wearer and an additional section of absorbent material in the forehead region to absorb sweat. The additional section of absorbent material may be included instead of the slick material or in addition to the slick material, such as attached to a region of the slick lining material that faces the wearer's forehead, or that is position directly under the slick lining material in the forehead region. While described as positioned in only a small region of the slick lining material or cap, e.g., the forehead region, the absorbent material could also be positioned around a full circumference of the cap, such as around a full circumference of the side panel 13. For example, the absorbent material may be included as a full second inner layer of the lining 30.

With continued reference to FIG. 1B, the head covering 10 may also include a pouch 16. The pouch 16 may be permanently or releasably attached along a back side of the side panel (24). The releasable attachment may include any of the connection means known in the art, such as one or more hook and loop closures, snaps, buttons, a zipper, or any combination thereof. In this way, various sizes and configurations of the pouch portion 16 may be used in conjunction with the cap portion 12 to customize the head covering 10 for the wearer's hair volume and style.

The pouch portion 16 may include a cinchable border 22 configured to collapse a circumferential opening of the pouch portion, thus working to close the pouch portion about a length of the wearer's hair that extends from a nape of the wearer's neck. An exemplary cinchable border comprises an elastic band of material arranged in a pocket on an edge of the circumferential opening.

Figure 1C:
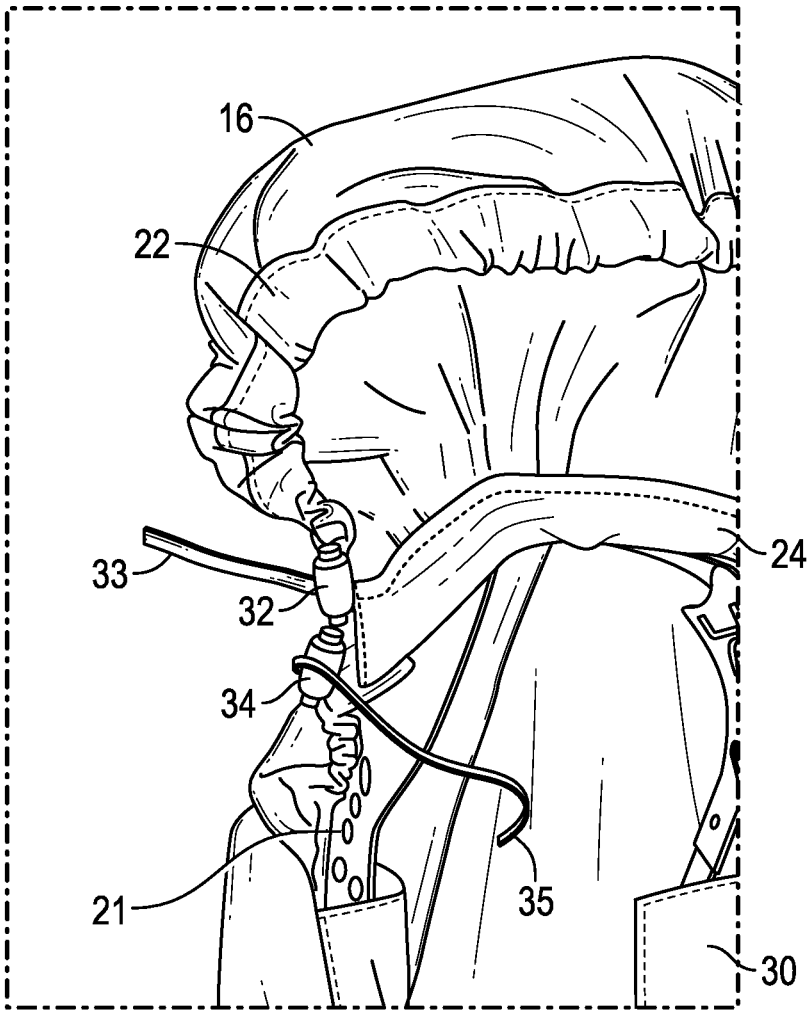
FIG. 1C illustrates a bottom inside view of the head covering of FIG. 1B showing internal components and a frame according to various aspects of the present disclosure.

Another exemplary cinchable border comprises a cord arranged in a pocket on an edge of the circumferential opening that is securable at the desired opening size by a cord lock. With reference to FIG. 1C, a first end of an exemplary cord 33 and a cord lock 32 are shown exiting from one end of the cinchable border 22 of the pouch portion 16 (a second end of the cord and cord lock are not shown in the figure but would be found on an opposite mirror side of the head covering). Alternatively, as shown in FIG. 4A, the cord 33*a* may be formed as a full circle, i.e., having no ends, and a single cord lock 32*a* may be positionable on the cord to secure the cord to a size that forms the desired opening side for the pouch.

Figure 3:
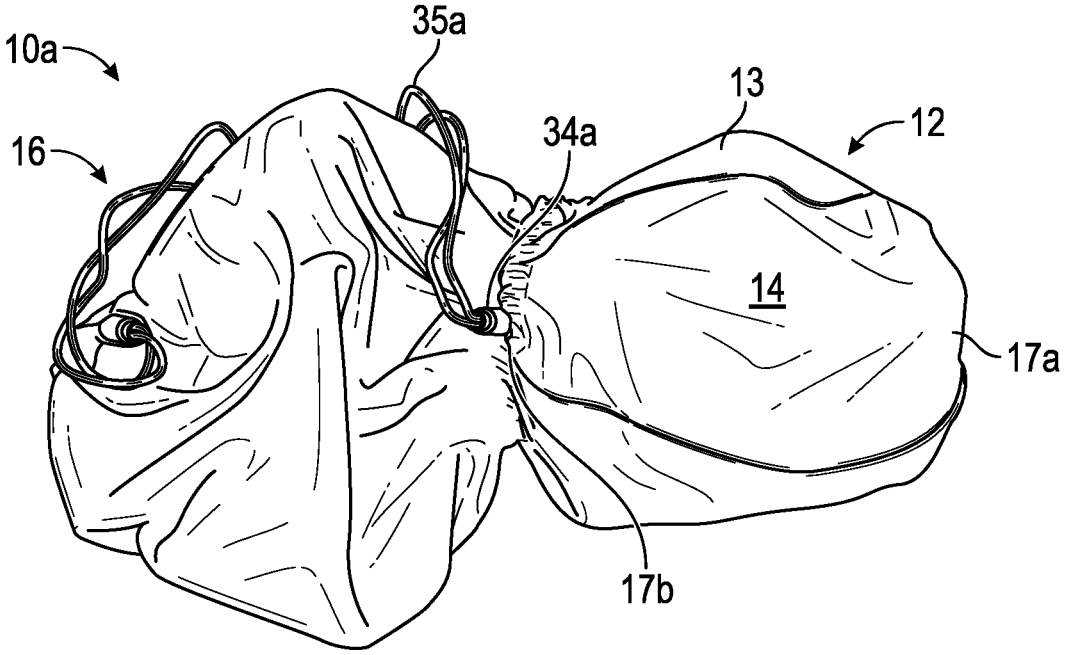
FIG. 3 illustrates a top view of a head covering with an attached pouch portion according to various aspects of the present disclosure.

An edge of the side panel 13 distal from the top panel 14 of the cap portion 12 (e.g., distal edge of the side panel) may comprise an adjustment element 23 configured to change an opening size of the side panel, thus working to close the cap portion about the wearer's hair that extends from a top and sides of the wearer's head. An exemplary adjustment element 23 may comprise a cord arranged in a pocket on the edge of the side panel, wherein the cord is securable at a desired opening size by a cord lock. With reference to FIG. 1C, an exemplary cord 35 and cord lock 34 are shown exiting from one end of the adjustment element 23 of the cap portion 12 (a second end of the cord and cord lock are not shown in the figure but would be found on an opposite mirror side of the head covering). Alternatively, as shown in FIG. 3, the cord 35*a* may be formed as a full circle, i.e., having no ends, and a single cord lock 34*a* may be positionable on the cord to secure the cord to a size that forms the desired opening side for the cap portion 12.

The adjustment element 23 (cord 35) has been described as arranged in a pocket on the edge of the side panel, such as a pocket provided along a full circumferential opening in the cap portion 12. The pocket may be positioned in only short section of the circumferential opening of the cap portion 12, such as in regions proximate to the pouch portion 16. In this way, one end each cord 35 may be permanently attached at an end of the pocket, i.e., distal from the pouch portion, and the other end may exit the pocket and include a cord lock 34, much as shown in FIG. 1C. In this way, the front side 17*a* of the side panel 13 adjacent the wearer's forehead may remain smooth, and only side regions of the cap portion 12 adjacent the pouch portion 16 (e.g., toward a back of the cap portion 12) may be cinched using the adjustment elements.

According to certain aspects, the cap portion 12 of the head covering 10 may be adjusted via a snap, ratchet, or hook and loop closure at a back side 17*b* of the side panel 13, such as a baseball cap. The closure may include an opening in the back side 17*b* of the cap portion 12 that may allow the wearer's hair to pass so that the closure is secured beneath the hair at the nape of the neck of the wearer.

Figure 2A:
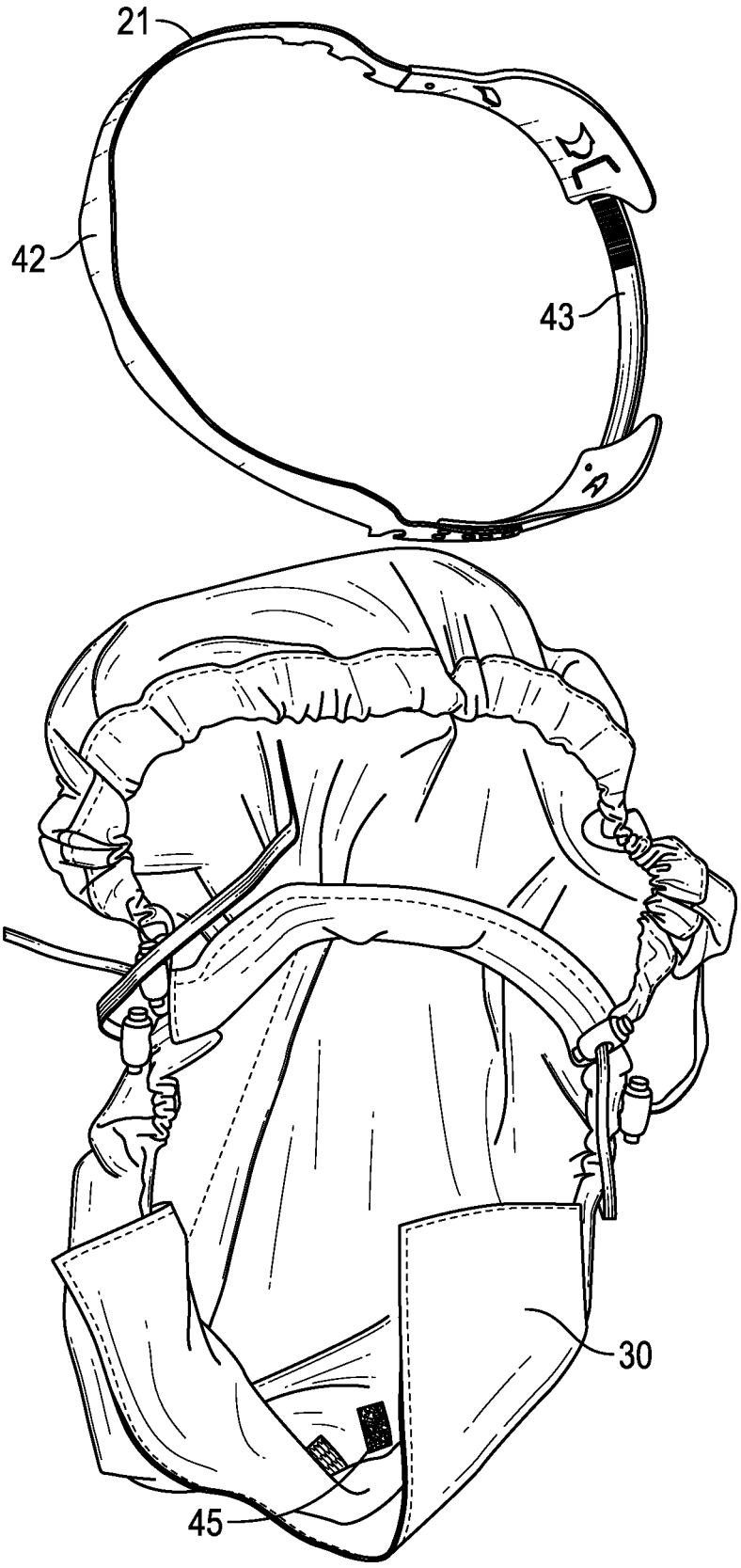
FIG. 2A illustrates an exploded view of the head covering shown in FIG. 1B with the frame removed from the cap portion.
Figure 2B:
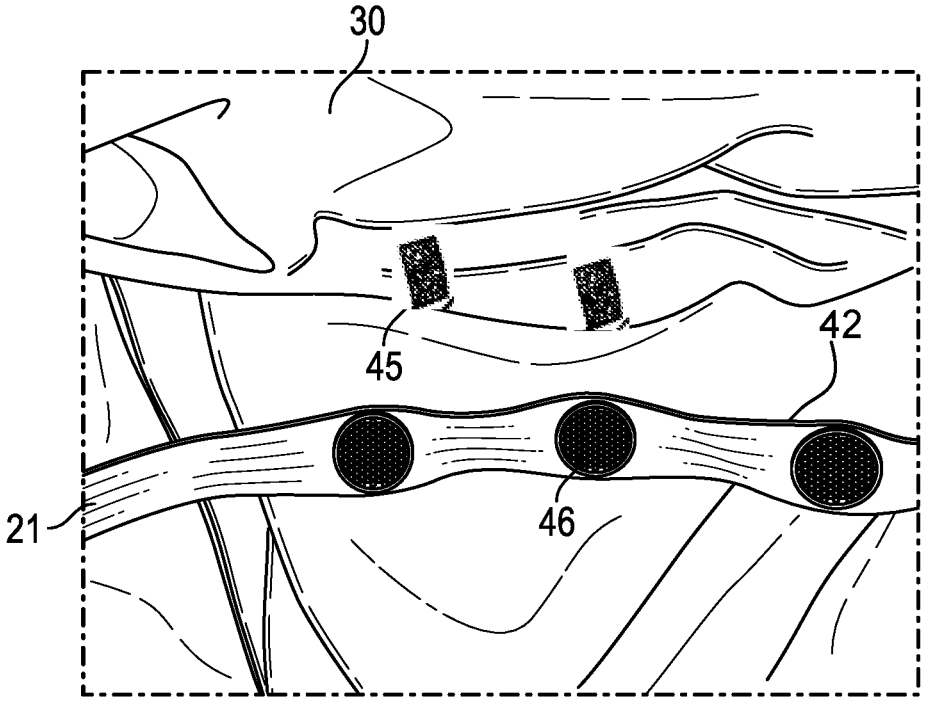
FIG. 2B illustrates a close-up bottom inside view of the head covering of FIG. 2A showing attachment elements between the frame an inner circumference of a cap portion.

With reference to FIGS. 2A and 2B, a frame 21 of the head covering 10 is shown. The frame 21 is positionable on an interior side of the side panel 13 and configured to adjust a circumferential diameter thereof to fit the wearer's head. Head shape and size vary amongst different people and a particular individual's head geometry may not be symmetrical. Moreover, depending upon the activity involved, and the environment of use, a wearer may desire a tighter or looser fit. Accordingly, the frame 21 may comprise at least two separate portions connectable and moveable independent of each other to adjust the circumferential diameter of the frame 21.

For example, as shown in FIG. 2A, the frame may include a main or front portion 42 and a rear adjustment portion 43, wherein ends of the rear adjustment portion 43 may slide within receptacles (44) at ends of the main portion 42 to adjust a distance between the ends of the main portion (i.e., adjust a circumferential diameter of the frame). The frame may be configured and positioned within the head covering 10 to encircle the head of the wearer, with the main portion 42 extending laterally across the forehead region of the wearer's head over the ears and the rear adjustment portion 43 extending across a rear of the wearer's head, such as at a nape of the neck or base of the skull.

The wearer may selectively customize a fit characteristic (e.g., shape, size, to orientation or pressure), either prior to placing the head covering on their head, or while already wearing the head covering. According to certain aspects, the ends of the rear adjustment portion 43 may include a series of teeth that engage a closure member in each of the receptacles 44 (e.g., a zip tie locking ratchet). Thus, as the ends of rear adjustment portion 43 are fed through the receptacles 44 and past the closure member, the teeth may engage the closure member to secure the ends of the rear adjustment portion 43 in a certain position (i.e., secure a circumference of the frame 21). The receptables 44 may include a button or other disengagement member that may provide release of the closure member from the teeth so that the frame may be opened.

According to certain aspects, the receptables may be positioned at ends of the rear adjustment portion 43, and the ends of the main portion 42 may include a series of teeth that engage a closure member in each of the receptacles 44 (e.g., a zip tie locking ratchet). Thus, as the ends of the main portion 42 are feed through the receptacles 44 and past the closure member, the teeth may engage the closure member to secure the ends of the main portion 42 in a certain position (i.e., secure a circumference of the frame 21).

The frame 21 may be positioned within the inner circumference of the side panel 13, such as adjacent the distal edge thereof (i.e., edge comprising the adjustment element 23 shown in FIG. 1B). The frame may be releasably attached to the cap portion 12, such as anywhere along the inner circumference of the side panel 13. For example, as shown in FIG. 2B, the frame 21 may be attachable to the inner circumference of the side panel 13 adjacent the front side thereof (17*a*), such as by one or more attachment elements 46 configured to connect to paired attachment elements 45 on the inner circumference of the side panel 13. Exemplary attachment elements comprise hook and loop closures, snaps, buttons, or any combination thereof. Accordingly, the frame may be removed from the cap portion so that the cap portion and/or frame may be washed.

With continued reference to FIG. 2B, the lining 30 may be configured so that it covers the frame 21, or at least a front portion thereof, when it is positioned within the cap portion 12. As such, any attachment means used to connect the top longitudinal edge of the lining 30 for releasable connection to the interior of the side panel should be positioned to not obstruct the frame or any attachment elements (45, 46) used to connect the frame 21 to the inner circumference of the side panel 13. As shown in FIG. 4B, when the lining is configured to extend around 100% of the inner circumference of the side panel 13, the frame 21 may be positionable along the inner circumference of the side panel 13 so that the lining 30 may fold over and fully enclose the frame.

The frame 21 may further include attachment means, such as clips or hooks, that may allow the head covering and/or frame to be hooked to a rack for storage or cleaning, or a waist band, such as the waist band of scrubs, for easy transport while not wearing. The frame 21 may also include attachment points for various pieces of equipment, such as lights, glasses, face masks, and the like. For example, when the head covering is used as a surgical cap, the equipment may include devices commonly found in the operating room and worn by a surgeon, nurse, etc. during a procedure.

Figure 5A:
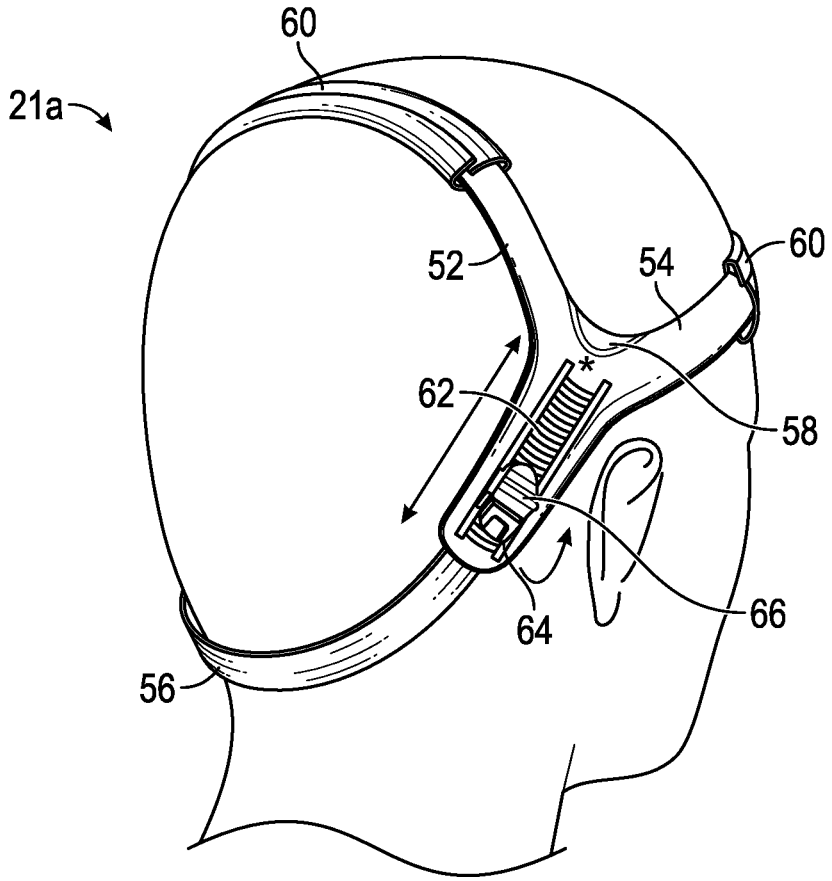
FIG. 5A illustrates a frame for a head covering according to various aspects of the present disclosure.
Figure 5B:
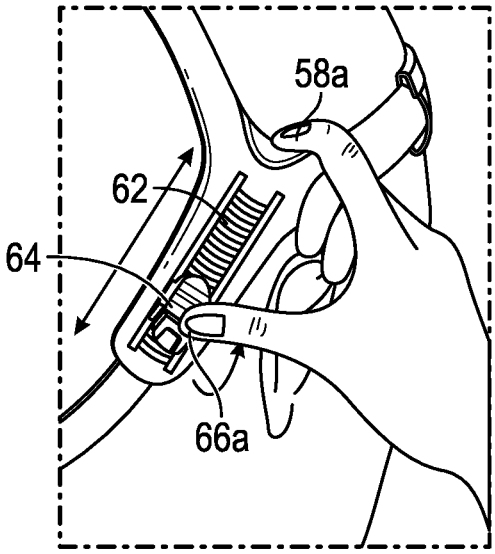
FIG. 5B illustrates a close-up view of an adjustment element of the frame of FIG. 5A.

An alternate frame 21*a* is shown in FIGS. 5A and 5B. The frame 21*a* may include a top band 52, front band 54, and back band 56. When worn, the frame 21*a* engages and encircles the head of the wearer, with the front band 54 extending laterally across the forehead region of the wearer's head from ear to ear and the top band 52 connecting to the front band near the wearer's ears and extending across the top of the head. As such, the frame 21*a* rests on the top of the wearer's head and forehead and is positioned over the wearer's ears. The back band 56 extends across a rear of the wearer's head, such as at the nape of the neck at or below the wearer's hairline, to extend the frame 21*a* around a full circumference of the wearer's head.

As shown in FIG. 5A, each of the ends of the top, front, and back bands may intersect at a central point of the frame (see star in FIG. 5A) so that the frame 21*a* forms a cage-like structure sized and designed to fit a wearer's head. The front and top bands may be formed as an integral or one-piece construction, wherein a region adjacent the ends of each of the front and top bands (54 and 52, respectively) may extend rearward, i.e., toward the back band 56, and may include a ribbed track 62 or adjustment element. Ends of the back band 56 may be connected to the ribbed track 62 via a button 64. The button 64 may engage with the ribbed track, i.e., zip-tie style connection, to secure a position of the button 64 thereon. Thus, the back band 56 provides adjustment of a circumferential size of the frame 21*a* by changing the distance between ends of the front band 54.

As shown in FIG. 5B, the wearer may use fingers, such as a thumb 66*a* positioned on a moveable clamp 66 portion of the button 64 and a forefinger 58*a* positioned within a finger ridge 58, to move the button 64 along the ribbed track 62. When the button 64 is brought toward the wearer's ears, i.e., fingers are squeezed together using the finger ridge 58 to provide counterforce, the length of the back band 56 is shortened and the frame 21*a* is tightened to secure it on the wearer's head. The wearer may engage an opposite side of the moveable clamp 66 to move the button 64 backward away from their ears (i.e., toward a back of the neck), thus lengthening the back band 56 to loosen the frame 21*a* (both motions represented by the arrow in FIGS. 5A and 5B).

The frame 21*a* may include a single ribbed track 62, and a single end of the back band 56 may be connected to the ribbed track 62 via a button 64, while the opposite end of the back band 56 may be permanently attached to the frame along an opposite lateral side. Alternatively, and preferably, the frame includes two ribbed tracks 62, such as one at each side of the frame 21*a* in the region that is configured to be adjacent and above the wearer's ears, and each end of the back band 56 may be connected to a respective ribbed track 62 via a button 64. As such, the wearer may selectively customize a fit characteristic of the frame 21*a* (e.g., shape, size, to orientation or pressure) along each lateral side thereof. Moreover, the frame 21*a* may be provided with various lengths of the top band 52 to offer different cage sizes, much as small, medium, large, and the like, sizing for hats or caps.

Figure 5C:
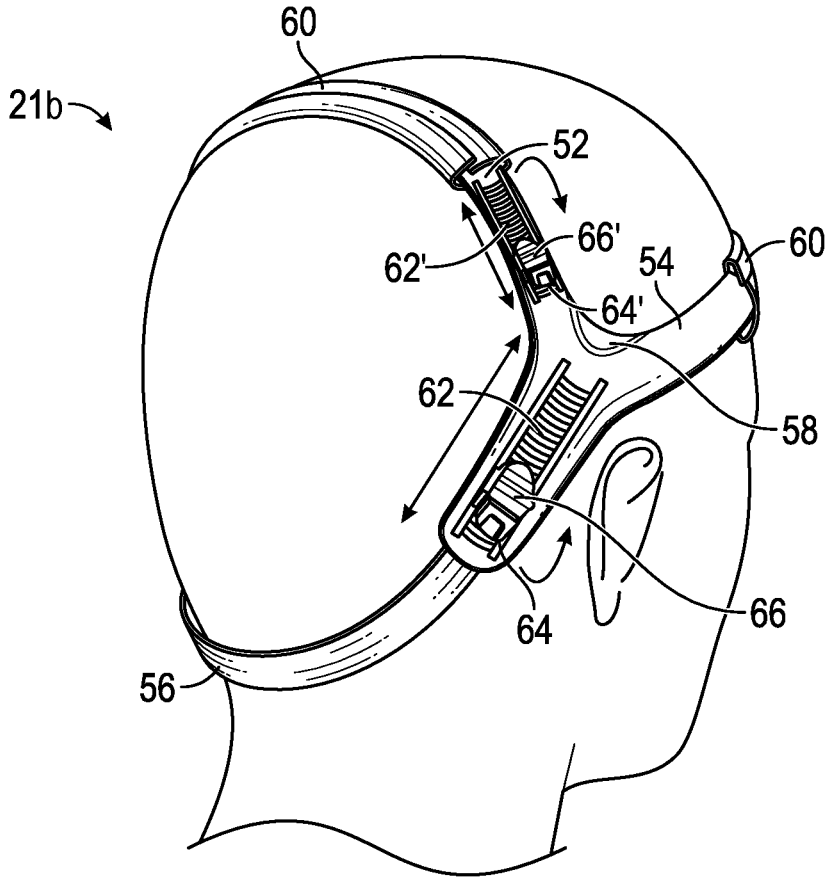
FIG. 5C illustrates a frame for a head covering according to various aspects of the present disclosure.

Another alternate frame 21*b* is shown in FIG. 5C that offers additional adjustment of the cage size so that a single frame may be adjustable to fit a wide range of head sizes. The frame 21*b* may include a top band 52, front band 54, and back band 56, much as shown and described for frame 21*a* shown in FIGS. 5A and 5B. Each of the ends of the top, front, and back bands may intersect at a central point of the frame so that the frame 21*b* forms a cage-like structure sized and designed to fit a wearer's head. The front band may be formed as a one-piece construction, wherein a region adjacent opposing ends thereof may extend upward toward a top of the head, and the opposing ends may include a ribbed track 62 or adjustment element on one or both sides. One or both ends of the back band 56 may be connected to the ribbed track 62 via a button 64. The button 64 may engage with the ribbed track, i.e., zip-tie style connection, to secure a position of the button 64 thereon, and may be moveable as described hereinabove to adjust a circumferential size of the frame 21*b* by changing the distance between ends of the front band 54.

As shown in FIG. 5C, the frame 21*b* may also provide adjustment of the top band 52 by inclusion of an adjustment element on one or both end regions thereof. That is, the top band 52 may include a button 64' engageable with a ribbed track 62' on the upward extending regions of the front band 54. The wearer may use fingers on a moveable clamp 66' portion of the button 64' to move the button 64' along the ribbed track 62'. When the button 64' is brought toward the wearer's ears, i.e., fingers are squeezed together, the length of the top band 52 is shortened and the size of the frame 21*b* is made smaller to secure it on the wearer's head. The wearer may engage an opposite side of the moveable clamp 66' to move the button 64' backward away from their ears (i.e., toward a top of the head), thus lengthening the top band 52 to loosen the frame 21*b* (both motions represented by the arrow in FIG. 5C).

The front band 54 may include a single upward extending region having an attachment element (e.g., a ribbed track 62' on one lateral side only) or may include upward extending regions having an attachment element on each side of the frame 21*b*. Accordingly, the top band 52 may include an adjustment element (e.g., a button 64' with moveable clamp 66') on one end engageable with the ribbed track 62' or may include an adjustment element on each end thereof. When only one adjustment/attachment element combination is included on one lateral side of the frame 21*b*, the other lateral side may have the top band 52 permanently attached to the front band 54 as shown in FIGS. 5A and 5B.

Each of the front band 54 and top band 52 may include padding 60 that may improve comfort of the frame on the wearer's head and/or may help to absorb sweat. The padding 60 may be removeable and/or replaceable for washing or exchange. The padding 60 may cover at least 30% of the length of the front or back band, such as at least 40% of the length, or at least 50%, or at least 60%, or at least 70%.

The padding 60 may be formed around both the top and bottom sides of the front and top bands (54 and 52, respectively), or may be attached to the bottom side, i.e., underside of the bands that face inward toward the wearer's head. The padding 60 may be a soft, compressible, and conforming material, i.e., Poron® (polyurethane) foam, CoolMax® liner, CoolMax® liner woven with silver, and like liner materials. The liner may further be textured for breathability and ease in conforming to a user's head. The padding 60 may be attached using a hook and loop fastener system (Velcro™), adhesive, or the like.

The front and top bands (54 and 52, respectively) of the frame 21*a* may be formed of a durable but flexible material, such as synthetic polymeric materials and the like (e.g., polyethylene, polypropylene, etc.). The back band 56 may be formed of a stretchable material for comfort and to increase the ease of attachment over the wearer's head and hair (i.e., band will be positioned under the wearer's hair at the nape of the neck). The stretchable material may be any of an elastomeric polymer, an elastic textile, and the like.

Figure 6A:
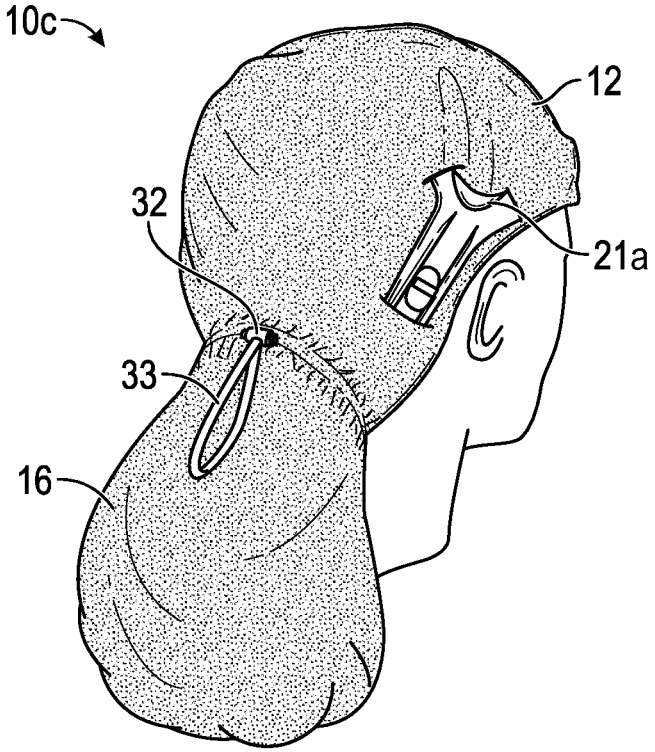
FIGS. 6A and 6B illustrate back views of head coverings according to various aspects of the present disclosure.

The frame 21*a* or 21*b* may be adjustable to fit the wearer's head either prior to placing the head covering on their head, or while already wearing the head covering. For example, as shown in FIG. 6A, the adjustment portion of the frame 21*a* may be positioned exterior to the cap portion 12 of the head covering 10*c* so that the frame may be adjusted while wearing the head covering. That is, each of the ribbed track 62, finger ridge 58, and button 64 may be positioned exterior to the cap portion 12. For example, ends of the top band 52, front band 54, and back band 56 may each be positioned through slots in the cap portion 12 (e.g., three slots on each side of the cap portion) so that the ribbed track 62, finger ridge 58, and button 64 are outside the cap material. When additional adjustment is provided on the top band, such as shown in FIG. 5C, greater portions of the frame may be exposed, or extend through the slots in the cap.

Figure 6B:
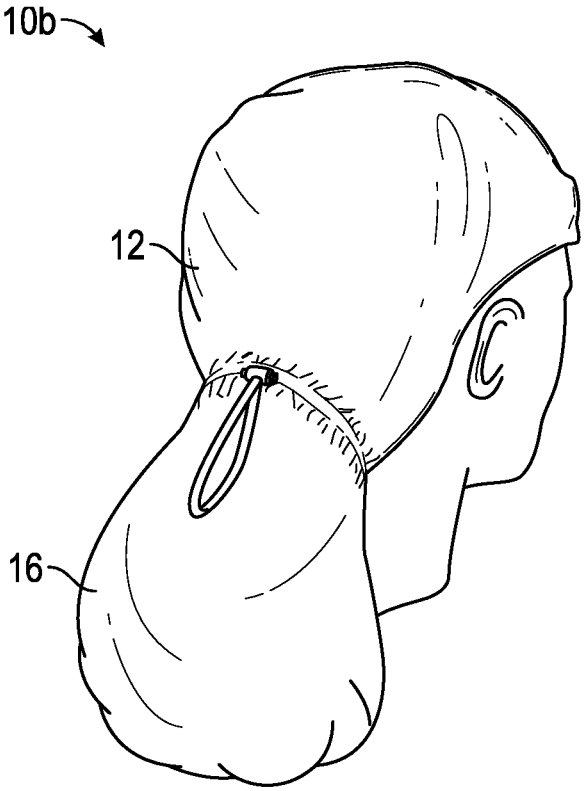

Alternatively, the cap portion 12 may fully enclose or encase the frame 21*a*, such as shown in FIG. 6B. As such, the wearer may adjust the frame 21*a* or 21*b* prior to positioning the head covering 10*b* over their head and hair (i.e., head covering 10*b* with the frame 21*a* positioned therein). The finger ridge 58 and the button 64 may be detectable and engageable underneath the fabric of the cap, and/or the button 64' on the top band 52. As such, even in cases where the cap portion 12 covers the frame 21*a* or 21*b*, a wearer may adjust the frame after the head covering is positioned on their head.

According to aspects, the cap portion 12 and pouch portion 16 may be attachable/detachable to the frame 21*a*, such as for laundering of the cap and pouch portions. In this scenario, the wearer may adjust the frame 21*a* absent the head covering 10*b* before positioning on their head or while it is positioned on their head and may attached the cap portion 12 to the frame 21*a* after it is adjusted. Attachment between the frame 21*a* and the cap portion 12 may be according to any of the attachments described herein (e.g., attachment elements such as Velcro®, positioning the frame beneath a liner, or both, etc.), or may be via snaps, buttons, or the like, such as positioned at the top and front bands of the frame 21*a*.

The following aspects are disclosed in this application:

Aspect 1: A head covering configured to contain and conceal a full volume of hair of a wearer, the head covering comprising: a cap portion having a top region, a circumferential side region defining a circumferential opening, wherein the side region extends from the top region and includes a front side and a back side configured to be coincident with a front and back, respectively, of a head of the wearer.

Aspect 2: The head covering according to the previous aspect, comprising: a pouch portion attachable at the back side of the cap portion.

Aspect 3: The head covering according to any one of the previous aspects, comprising: a flexible frame positionable substantially within an inner circumference of the cap portion, the frame configured to adjust a circumferential diameter thereof to fit the head of the wearer.

Aspect 4: The head covering according to any one of the previous aspects, comprising: a lining connected to at least the front side of the cap portion on an inner circumference thereof, wherein the lining comprises silk, satin, rayon, rayon related material (e.g., viscose, TENCEL, modal), peachskin, cupro, and any combination thereof.

Aspect 5: The head covering according to any one of the previous aspects, wherein the cap portion and/or pouch portion comprise a textile material.

Aspect 6: The head covering according to any one of the previous aspects, wherein an edge of the side region distal from the top region of the cap portion comprises an adjustment element configured to change a size of the circumferential opening.

Aspect 7: The head covering according to aspect 6, wherein the adjustment element comprises a cord arranged in a pocket on the edge of the side region, wherein opposing ends of the cord extend from openings in the pocket, and wherein the circumferential opening of the cap portion is securable at a desired opening size by a cord lock positioned at each end of the cord.

Aspect 8: The head covering according to aspect 7, wherein the openings in the pocket through which the ends of the cord extend are adjacent a connection point between the cap portion and the pouch portion.

Aspect 9: The head covering according to aspect 7, wherein the openings in the pocket through which the ends of the cord extend are on a back side of the side region of the cap portion.

Aspect 10: The head covering according to aspect 6, wherein the adjustment element comprises a non-ending cord arranged in a pocket on the edge of the side region, wherein a portion of the cord extends from the pocket on a back side of the side region, and wherein the circumferential opening of the cap portion is securable at a desired opening size by a cord lock positioned on the portion of the cord that extends from the pocket.

Aspect 11: The head covering according to any one of aspects 2 to 10, wherein the pouch portion is releasably connectable to the back side of the side region via one or more connection elements.

Aspect 12: The head covering according to any one of aspects 2 to 11, wherein the pouch portion has a cinchable border configured to collapse a circumferential opening of the pouch portion to contain and conceal a length of the wearer's hair extending from a nape of the wearer's neck.

Aspect 13: The head covering according to aspect 12, wherein the cinchable border of the pouch portion comprises any one of (i) a cord arranged in a pocket on an edge of the circumferential opening of the pouch portion that is securable at the desired opening size by a cord lock; (ii) an elastic band arranged in a pocket on an edge of the circumferential opening of the pouch portion or (iii) an elastic band attached to an edge of the circumferential opening of the pouch portion.

Aspect 14: The head covering according to any one of aspects 3 to 13, wherein the frame comprises one or more attachment elements configured to connect to paired attachment elements on an inner circumference of the cap portion at the front side thereof.

Aspect 15: The head covering according to any one of aspects 3 to 14, wherein the frame comprises at least two separate portions connectable and moveable independently of each other to adjust the circumferential diameter of the frame.

Aspect 16: The head covering according to any one of aspects 3 to 15, wherein the frame comprises a front portion and a rear adjustment portion, wherein opposing ends of the rear adjustment portion comprise teeth that engage with attachment elements on opposing ends of the front portion, wherein the attachment elements allow or restrict movement of the teeth such that a distance between the opposing ends of the front portion is changed to adjust the circumferential diameter of the frame.

Aspect 17: The head covering according to any one of aspects 3 to 13, wherein the frame comprises a front band, a back band, and a top band, wherein opposing ends of the top band and the front band are each connected at opposing lateral sides of the frame, and wherein one or both of the opposing lateral sides of the frame each comprise an attachment element that engages opposing ends of the back band.

Aspect 18: The head covering according to aspect 17, wherein the attachment element on each of the opposing sides of the frame comprise teeth, and wherein the opposing ends of the back band each comprise a button engageable with the teeth to allow or restrict movement of the opposing ends of the back band along the teeth and thus adjust the circumferential diameter of the frame.

Aspect 19: The head covering according to any one of aspects 3 to 13, wherein the frame comprises a front band configured to extend across the wearer's forehead, a back band configured to extend across a back of the wearer's head at the nape, and a top band configured to extend across a top of the wearer's head, wherein opposing ends of the top band and the front band are each connected at opposing lateral sides of the frame, wherein one or both of opposing end regions of the top band each comprise an adjustment element, and wherein one or both of the opposing lateral sides of the frame each comprise an attachment element that engages opposing ends of the back band.

Aspect 20: The head covering according to aspect 19, wherein the attachment element on each of the opposing sides of the frame comprise teeth, and wherein the opposing ends of the back band each comprise a button engageable with the teeth to allow or restrict movement of the opposing ends of the back band along the teeth and thus adjust the circumferential diameter of the frame.

Aspect 21: The head covering according to aspects 19 or 20, wherein the adjustment element on one or both of the end regions of the top band comprise a button engageable with teeth, wherein ends of the top band may include the button and the opposing lateral sides of the frame may include the teeth on which the button may be engaged to allow or restrict movement of the opposing ends of the top band along the teeth, thus adjusting a length of the top band; or wherein ends of the top band may include the teeth and the opposing lateral sides of the frame may include the button engageable with the teeth to allow or restrict movement of the opposing lateral sides of the frame along the teeth, thus adjusting a length of the top band.

While specific embodiments of the invention have been described in detail, it should be appreciated by those skilled in the art that various modifications and alternations and applications could be developed in light of the overall teachings of the disclosure. Accordingly, the particular arrangements, systems, apparatuses, and methods disclosed are meant to be illustrative only and not limiting as to the scope of the invention.

| Reference number | description |
|---|---|
| 10, 10a, 10b, 10c | head covering |
| 12 | cap portion of 10 |
| 13 | side panel or region of the cap portion 12 |
| 14 | top panel or region of cap portion 12 |
| 16 | pouch portion of head covering 10 |
| 17a | front side of side panel 13 |
| 17b | back side of side panel 13 |
| 20 | head receiving cavity |
| 21, 21a, 21b | frame |
| 22 | cinchable border |
| 23 | adjustment element (similar to cinchable border) |
| 24 | inside region of back side 17b of side panel 13 |
| 30 | lining on inside of cap portion 12 |
| 32, 32a, 34, 34a | cord |
| 33, 33a, 35, 35a | cord lock |
| 42 | front portion of frame 21 |
| 43 | rear adjustment portion of frame 21 |
| 44 | receptacles on front portion 42 of frame 21 |
| 45 | attachment elements on front side 17b of side panel |
| 46 | attachment elements on front portion 42 of frame 21 |
| 52 | top portion of frame 21a, 21b |
| 54 | front portion of frame 21a, 21b |
| 56 | back portion of frame 21a, 21b |
| 58 | finger ridge |
| 58a | finger (forefinger) |
| 60 | padding on top and front portions (52, 54) |
| 62, 62' | ribbed track |
| 64, 64' | button operably connected to ribbed track 62, 62' |
| 66, 66' | moveable clamp on button (64, 64') that releases the button for free motion on track 62, 62' |
| 66a | thumb |

What is claimed is:

1. A head covering configured to contain and conceal a full volume of hair of a wearer, the head covering comprising:

a cap portion having a top region, a circumferential side region defining a circumferential opening, wherein the side region extends from the top region and includes a front side and a back side configured to be coincident with a front and back, respectively, of a head of the wearer;

a pouch portion attachable at the back side of the side region; and a flexible frame positionable substantially within an inner circumference of the cap portion, the frame comprising at least two separate portions connectable and moveable independently of each other to adjust a circumferential diameter thereof to fit the head of the wearer, wherein the cap portion and pouch portion comprise a textile material, and, wherein the two portions of the frame comprise a front portion and a rear adjustment portion, wherein opposing ends of the rear adjustment portion comprise teeth that engage with attachment elements on opposing ends of the front portion, wherein the attachment elements allow or restrict movement of the teeth such that a distance between the opposing ends of the front portion is changed to adjust the circumferential diameter of the frame.

2. The head covering of claim 1, wherein an edge of the side region distal from the top region of the cap portion comprises an adjustment element configured to change a size of the circumferential opening.

3. The head covering of claim 2, wherein the adjustment element comprises a cord arranged in a pocket on the edge of the side region, wherein opposing ends of the cord extend from openings in the pocket, and wherein the circumferential opening of the cap portion is securable at a desired opening size by a cord lock positioned at each end of the cord.

4. The head covering of claim 3, wherein the openings in the pocket through which the ends of the cord extend are adjacent a connection point between the cap portion and the pouch portion.

5. The head covering of claim 3, wherein the openings in the pocket through which the ends of the cord extend are on a back side of the side region of the cap portion.

6. The head covering of claim 2, wherein the adjustment element comprises a non-ending cord arranged in a pocket on the edge of the side region, wherein a portion of the cord extends from the pocket on a back side of the side region, and wherein the circumferential opening of the cap portion is securable at a desired opening size by a cord lock positioned on the portion of the cord that extends from the pocket.

7. The head covering of claim 1, wherein the pouch portion is releasably connectable to the back side of the side region via one or more connection elements or non-releasably attached to the back side of the side region.

8. The head covering of claim 1, wherein the pouch portion has a cinchable border configured to collapse a circumferential opening of the pouch portion to contain and conceal a length of the wearer's hair extending from a nape of the wearer's neck.

9. The head covering of claim 8, wherein the cinchable border of the pouch portion comprises any one of (i) a cord arranged in a pocket on an edge of the circumferential opening of the pouch portion that is securable at the desired opening size by a cord lock; (ii) an elastic band arranged in a pocket on an edge of the circumferential opening of the pouch portion or (iii) an elastic band attached to an edge of the circumferential opening of the pouch portion.

10. The head covering of claim 1, further comprising:

a lining connected to at least the front side of the cap portion on an inner circumference thereof, wherein the lining comprises silk, satin, rayon, viscose, lyocell, modal, peachskin, cupro, and any combination thereof.

11. The head covering of claim 1, wherein the frame comprises one or more attachment elements configured to connect to paired attachment elements on an inner circumference of the side region at the front side thereof.

12. A head covering configured to contain and conceal a full volume of hair of a wearer, the head covering comprising:

a cap portion having a top region, a circumferential side region defining a circumferential opening, wherein the side region extends from the top region and includes a front side and a back side configured to be coincident with a front and back, respectively, of a head of the wearer;

a pouch portion attachable at the back side of the side region; and a flexible frame positionable substantially within an inner circumference of the cap portion, the frame configured to adjust a circumferential diameter thereof to fit the head of the wearer, wherein the cap portion and pouch portion comprise a textile material, wherein the frame comprises a front band, a back band, and a top band, wherein opposing ends of the top band and the front band are each connected at opposing lateral sides of the frame, and wherein one or both of the opposing lateral sides of the frame each comprise an attachment element that engages opposing ends of the back band, and wherein the attachment element on each of the opposing sides of the frame comprise teeth, and wherein the opposing ends of the back band each comprise a button engageable with the teeth to allow or restrict movement of the opposing ends of the back band along the teeth and thus adjust the circumferential diameter of the frame.

13. The head covering of claim 12, wherein one or both of opposing end regions of the top band each comprise an adjustment element, and wherein one or both of the opposing lateral sides of the frame each comprise an attachment element that engages the adjustment element, wherein the attachment element comprises teeth and the adjustment element comprises a button engageable with the teeth to allow or restrict movement of the opposing ends of the top band along the teeth, thus adjusting a length of the top band.

14. The head covering of claim 12, wherein one or both of opposing end regions of the top band each comprise an attachment element, and wherein one or both of the opposing lateral sides of the frame each comprise an adjustment element that engages the attachment element, wherein the attachment element comprises teeth and the adjustment element comprises a button engageable with the teeth to allow or restrict movement of the opposing lateral sides of the frame along the teeth, thus adjusting a length of the top band.

15. A head covering configured to contain and conceal a full volume of hair of a wearer, the head covering comprising:

a cap portion sized and designed to fit over a head of the wearer, the cap portion having a front side and a back side configured to be coincident with a front and back, respectively, of the head of the wearer;

a pouch portion attachable at the back side of the cap portion along a circumferential edge of the cap portion;

a lining connected at the front side of the cap portion on an inner circumference thereof, wherein the lining is configured to prevent traction at a hairline of the wearer; and a flexible frame positionable substantially within the inner circumference of the cap portion, the frame configured to adjust a circumferential diameter thereof to fit the head of the wearer, wherein the frame comprises a front portion and a rear adjustment portion, wherein opposing ends of the rear adjustment portion comprise teeth that engage with attachment elements on opposing ends of the front portion, wherein the attachment elements allow or restrict movement of the teeth such that a distance between the opposing ends of the front portion is changed to adjust the circumferential diameter of the frame, wherein the cap portion and pouch portion comprise a textile material.

16. The head covering of claim 15, wherein the pouch portion is releasably connectable to the back side of aside region of the cap portion via one or more connection elements or non-releasably attached to the back side of the side region.

17. The head covering of claim 15, wherein the pouch portion has a cinchable border configured to collapse a circumferential opening of the pouch portion to contain and conceal a length of the wearer's hair extending from a nape of the wearer's neck.

18. The head covering of claim 15, wherein the frame comprises one or more attachment elements configured to connect to paired attachment elements on the inner circumference of the cap portion at the front side thereof.

19. The head covering of claim 15, wherein the frame comprises a front band, a back band, and a top band, wherein opposing ends of the top band and the front band are each connected at opposing lateral sides of the frame, and wherein the opposing lateral sides of the frame each comprise an attachment element that engages opposing ends of the back band.

20. The head covering of claim 19, wherein the attachment element on each of the opposing sides of the frame comprise teeth, and wherein the opposing ends of the back band each comprise a button engageable with the teeth to allow or restrict movement of the opposing ends of the back band along the teeth and thus adjust the circumferential diameter of the frame.

* * * * *